US006505645B1

(12) United States Patent
Pack et al.

(10) Patent No.: US 6,505,645 B1
(45) Date of Patent: Jan. 14, 2003

(54) MULTIPLE HYDRAULIC VALVE ASSEMBLY WITH A MONOLITHIC BLOCK

(75) Inventors: Andreas S. Pack, Wauwatosa, WI (US); Eric N. Griesbach, North Prairie, WI (US); James E. Olsen, Oconomowoc, WI (US)

(73) Assignee: HUSCO International, Inc., Waukesha, WI (US)

( * ) Notice: Subject to any disclaimer, the term of this patent is extended or adjusted under 35 U.S.C. 154(b) by 0 days.

(21) Appl. No.: 09/972,540

(22) Filed: Oct. 8, 2001

(51) Int. Cl.[7] ..... F15B 13/08

(52) U.S. Cl. ..... 137/596.13; 137/596.16; 137/596.18

(58) Field of Search ..... 137/596.13, 596.16, 137/596.18

(56) References Cited

U.S. PATENT DOCUMENTS 4,357,955 A * 11/1982 Sauer ..... 137/596.16
4,941,508 A * 7/1990 Hennessy et al. ..... 137/596.13
5,056,561 A * 10/1991 Byers ..... 137/596.13
5,752,426 A * 5/1998 Ikei et al. ..... 137/596.18
6,186,172 B1 * 2/2001 Yoshida ..... 137/596.16
6,408,876 B1 * 6/2002 Nishimura et al. .... 137/596.15

OTHER PUBLICATIONS

Exhibit 1 is a control valve assembly previously used on construction equipment.
Exhibit 2 is a previous manifold with solenoid valves and hoses connected thereto.

* cited by examiner

*Primary Examiner*—Gerald A. Michalsky
(74) *Attorney, Agent, or Firm*—George E. Haas; Quarles & Brady LLP

(57) ABSTRACT

A valve assembly has a single piece body that houses a plurality of hydraulic valves. Each valve includes a spool which controls the flow of fluid between a pair of work ports in one side of the body and a pump inlet and a tank outlet. The valves are operated by selectively applying pressurized fluid to one end or the other of the spool. That pressure is provided by a conduit or a pilot valve that is attached to a control port in the one side of the body. Because the majority of the connections to the valve assembly are made to the one side of the body access is only required to that side.

18 Claims, 4 Drawing Sheets

MULTIPLE HYDRAULIC VALVE ASSEMBLY WITH A MONOLITHIC BLOCK

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic valves, and more particularly to assemblies having a common monolithic block in which a plurality of individually operable valves are formed.

2. Description of the Related Art

Construction equipment have movable members which are operated by hydraulic cylinder/piston arrangements. For example, a skid steer loader has a boom that is used to raise and lower an implement, such as a bucket for moving dirt. Hydraulic actuators are provided for raising and lowering the boom and for tilting the implement with respect to the boom. An additional hydraulic circuit often is provided for auxiliary equipment.

The flow of fluid to and from each hydraulic actuator typically is controlled by a spool valve which in turn is controlled by a pilot valve. In this installation, a common valve body, known as a monolithic block, or monoblock, has a plurality of bores extending between two opposing surfaces, a separate control spool is received in each bore. Movement of the control spool opens and closes passages between the actuator and hoses that connect to a pump and a tank. Other hydraulic lines are attached to the openings at each end of the bores. These hydraulic lines lead to the pilot valves located within the cab of the skid steer loader. When the user desires to activate a particular function on the equipment, the pilot valve associated with that function is operated to vary the hydraulic pressure applied to the ends of the related control spool. Increasing the pressure at one end of the bore, causes the spool to move toward the other end which positions the spool to open a passage between the pump and a work port connected to the actuator for the desired function. Applying pressure to the other end of the bore moves the spool valve in the opposite direction to a open a passage between the work port and the tank of the hydraulic system. When the pilot valve is released, both ends of the bore are connected to the tank thereby causing the control spool to assume a center position. In the case of a hydraulic cylinder, bidirectional movement of a more complex control spool connects one cylinder chamber to the pump or tank and the other cylinder chamber to the other one of the pump or tank.

As noted previously, a plurality of control spools are contained in bores in the monolithic block. Often it is difficult to connect all the various hydraulic lines for the pump, the tank, each actuator, and the pilot valves to a compact valve assembly block. In addition, pressure relief valves and other mechanisms also have to be provided in the hydraulic circuits. As a consequence, mechanics-servicing the machinery often have difficulty in disconnecting and reconnecting the various hydraulic lines attached to the valve block.

There is a current trend with respect to construction equipment away from manually operated or hydraulically piloted valves toward electro-hydraulically controlled valves. Electrical control simplifies the hydraulic plumbing as control valves do not have to be located in or near the operator cab. This change in technology also facilitates computerized control of various machine functions, to either assist the operator or prevent dangerous conditions from occurring. This too has created difficulties in that the control of a given piece of equipment may be a combination of manually operated hydraulic circuits and electrically operated ones. This further complicates the arrangement of hydraulic valves.

SUMMARY OF THE INVENTION

A hydraulic valve assembly includes a compact body that has two primary sides and at least two opposing secondary sides extending between the primary sides. A plurality of valve bores extend between the two opposing secondary sides, and an inlet and an outlet for the assembly communicate with the valve bores. Each valve bore also communicates with a different pair of work ports that open through one primary side. The body further includes a plurality of first control ports each extending from the one primary side to one end of a different one of the plurality of valve bores, and a plurality of second control ports each extending from the same primary side to another end of a different one of the plurality of valve bores.

A separate control spool is located in each of the valve bores for controlling flow of hydraulic fluid between the work ports and the inlet and outlet. The control spool also defines a chamber at each end of the respective valve bore and each chamber communicates either a first control port or a second control port. A plurality of pilot pressure control elements each received in a different one of the first control ports and second control ports to define pressure in a respective chamber of an associated one of the plurality of valve bores. In the preferred embodiment of the valve assembly, each pilot pressure control element is either a fluid conduit or an electrically operated valve.

By applying pressure at one end or the other end of the bore, the spool is moves to different positions in the bore. This causes the spool to form various passages between the inlet and outlet and the two work ports coupled to that bore.

DETAILED DESCRIPTION OF THE INVENTION

Figure 1:
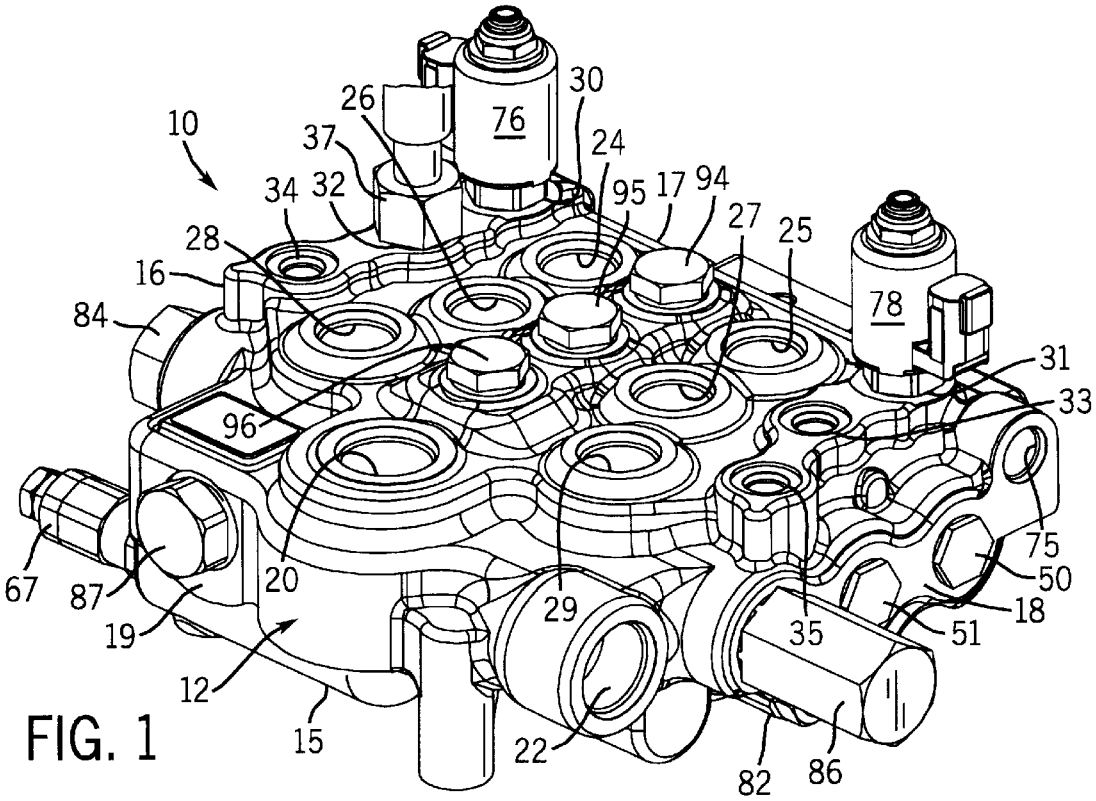
FIG. 1 is an isometric view of a valve assembly according the present invention.
Figure 2:
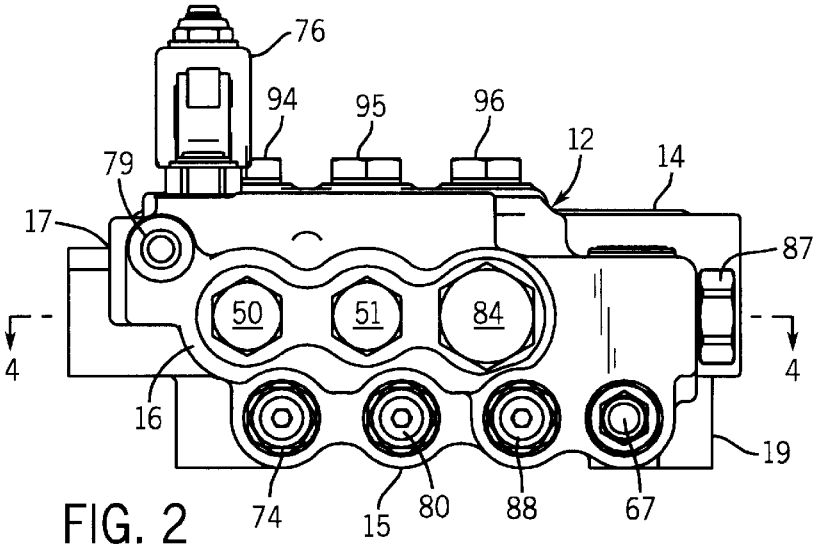
FIG. 2 is a plane view of one side of the valve assembly.
Figure 3:
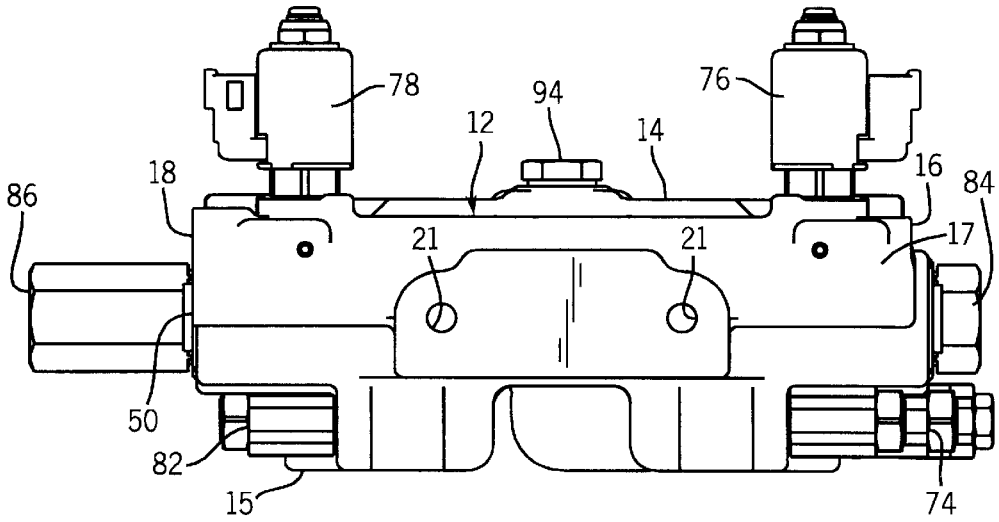
FIG. 3 is a plane view of another side of the valve assembly.

With initial reference to FIGS. 1 through 3, a hydraulic valve assembly 10 has a body 12 form of a single piece of metal having a first primary side 14 and a second primary sided 15. The body also has first, second, third, and fourth secondary sides 16, 17, 18 and 19, respectively. An inlet 20 is located in the first primary side 14 for connection to the outlet of a hydraulic pump that supplies pressurized fluid for operating the hydraulic circuit of which the valve assembly is a part. An outlet 22 is provided in the body, and extends into the third secondary side 18. The second secondary side 17 has two threaded apertures 21 for mounting the hydraulic valve assembly 10 to the equipment being controlled.

The valve body 12 has three separately operable valves therein each having a pair of work ports on the first primary side 14 for connecting three actuators, such as cylinders to the valve assembly. The first valve has work ports 24 and 25, the second valve is served by work ports 26 and 27, work ports 28 and 29 are associated with the third valve. Each valve is operated by pressure applied at a pair of control ports located in the first primary side 14. Specifically, the first valve is coupled to control ports 30 and 31, the second valve has control ports 32 and 33, while the third valve assembly is associated with control ports 34 and 35.

Figure 4:
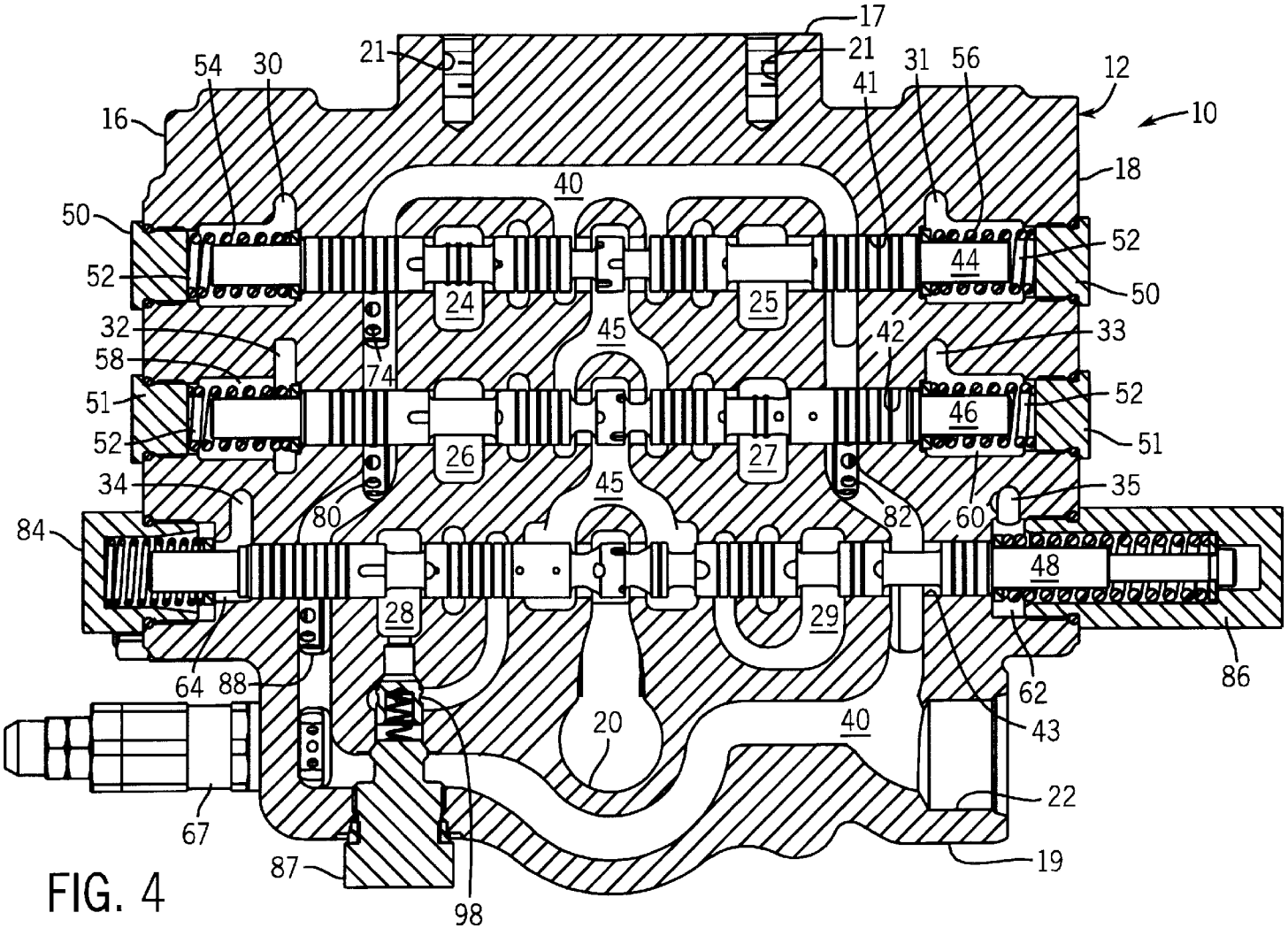
FIG. 4 is a cross-sectional view taken along line 4—4 in FIG. 2.

Referring to FIG. 4, the housing 12 has three bores 41, 42 and 43 extending between the first and third secondary sides 16 and 18, respectively. Each bore has a plurality of channels which communicate with the various ports in the body. For example, the inlet 20 communicates with a through-neutral passage 45 that leads to each bore. The outlet 22 communicates with an internal tank passage 40 which extends to a pair of channels on opposite sides of the through-neutral passage 45 in each bores 41–43. Work ports 24 and 25 extend from the first primary surface 14 into the first bore 41, and work ports 26 and 27 extend to the second bore 42. Work ports 28 and 29 extend into the third bore 43.

A first control spool 44 is slidably located within the first bore 41 thereby defining the end chambers 54 and 56. The ends of the first bore 41 are closed by simple plugs 50 and springs 52 bias the first control spool 44 away from those plugs. A second control spool 46 is similarly received in the second bore 42 and defines the end chambers 58 and 60. The ends of the second bore 42 are closed by another pair of plugs 51 and additional springs 52 bias the second control spool 46 away from those plugs 51. A third control spool 48 slides within the third bore 43, the ends of the which are closed by end caps 84 and 86. The third control spool 48 has four control states and thus is longer than the first and second spools 44 and 46 which have three control states. The ends of the third bore 43 are closed by end caps 84 and 86 which accommodate the travel of the longer third control spool and house the associated return springs. The forces exerted by the springs center the respective control spool-in a closed state within its respective bore when the associated valve is not activated. The first and second spools 44 and 46 optionally may be fitted with larger spring packs or detent latching devices.

It should be noted that end plugs 50 and 51, used in the first and second bores 41 and 42, eliminate the need for standard elongated end caps, such as 84 and 86, which extend significantly beyond the sides of the valve body 12.

Figure 5:
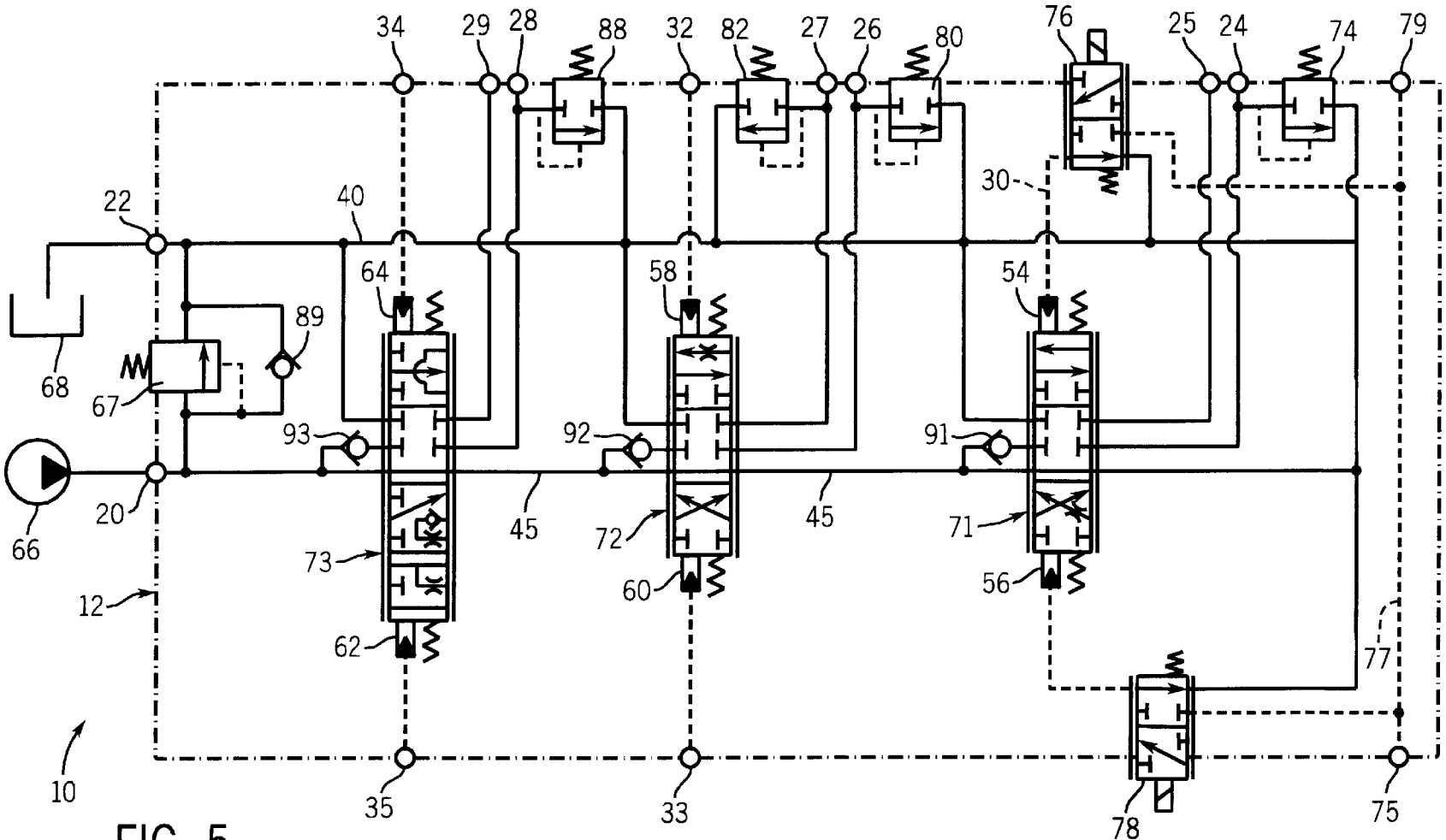
FIG. 5 is a schematic representation of the hydraulic circuit of the valve assembly.

FIG. 5 illustrates the hydraulic circuit formed within the valve assembly 10. A pump 66 supplies pressurized hydraulic fluid to the inlet 20 of the body 12 and the outlet 22 of the body is connected to the system tank 68. A primary pressure relief valve 67, also visible in FIGS. 1 and 4 is positioned to relieve the pressure at inlet 20 to the internal tank passage 40 and outlet 22 in the event that the inlet pressure exceeds a given level. The inlet 20 and outlet 22 are coupled by interior channels in the body to the three control valves 71, 72 and 73. The first control valve 71 is formed by the first bore 41 and the first control spool 44 and is a three position valve which controls the flow of fluid to and from a pair of auxiliary work ports 24 and 25. Work port 24 is connected to a pressure relief valve 74 which relieves excessive work port pressure to the tank outlet 22. As seen in FIG. 2, the pressure relief valve 74 is located on the first secondary side 16 of the body 12 below the end plug 50 for the first bore 41.

The first valve 71 is controlled by a pair of electrically operated solenoid valves 76 and 78. The first solenoid valve 76 is mounted in control port 30 thereby selectively connecting the chamber 54 at one end of the first bore 41 to either the tank outlet 22 or a pilot pressure inlet port 75 on the third valve body side 18 (see FIG. 1). The second solenoid valve 78 is mounted in control port 31 and selectively couples the control chamber 56 at the other end of the first spool bore 41 to either the tank outlet 22 or the pilot pressure inlet port 75. In the normal, or de-energized, state of these solenoid valves 76 and 78, the respective chamber 54 and 56 of the valve bore 41 is connected to tank. In the energized state, the solenoid valve 76 or 78 couples the respective bore chamber 54 or 56 to the pilot pressure inlet port 75 thereby applying a relatively high pressure which moves the first control spool 44 away from that end of the first bore 41. Thus, the first valve 71 is moved in opposite directions by energizing one of the solenoid valves 76 and 78.

The second valve 72 controls the flow of hydraulic fluid to and from work ports 26 and 27 in response to pressures at control ports 32 and 33. These work ports are connected to a cylinder (not shown) which controls the implement connected to the boom of the exemplary skid steer loader. The control ports 32 and 33 are machined to accept a fluid conduit (e.g. hydraulic hose fitting 37 in port 32, FIG. 1) which leads to a remote pilot valve that is manually operated by the user of the hydraulic equipment. Alternatively, a hose fitting from a remote pilot valve can be connected to the end openings of one or more of the spool bores 41–43 in place of the end caps 50 and 51. In that case the control ports associated with those spool bores 41–43 would be plugged. Operation of the hydraulic valve in one direction applies pressurized fluid to one of the control ports 32 or 33 and movement of the pilot valve in the opposite direction applied pressurized fluid to the other control port 33 or 32. This produces in bidirectional movement of the second control spool 46. Both of the work ports 26 and 27 have individual pressure relief valves 80 and 82, respectively. As shown in FIG. 2, the relief valve 80 associated with work port 26 is received in an aperture that is located on the first secondary side 16 of the valve body 12 below the end plug 51 for the associated second valve 72. The other relief valve 82 for work port 27 is located in an opening through the third valve body surface 18, shown in FIG. 3, at a location below the other end plug 51 for the second valve. The inner ends of the relief valves 80 and 82 communicate with the tank passage 40 through the valve body 12 as seen in FIG. 4.

The third control valve 73 is a four position type valve which regulates the flow of fluid between work ports 28 and 29 which in the example of a skid steer loader leads to the cylinder for the boom. Specifically, work port 28 connects to the base-side chamber of the cylinder and is pressurized to raise the boom, while work port 29 connects to the rod-side chamber and is pressurized to lower the boom. The third control valve 73 is formed by the third spool 48 and its associated third bore 43 within the valve body 12. The chambers 62 and 64 at opposite ends of the third spool are connected to control ports 34 and 35, respectively. These control ports 34 and 35 have been machined to accept a standard fitting of a hydraulic hose that connects to another manual pilot valve in the cab of the skid steer loader. As with the second control valve 72, operation of this other pilot valve by the user moves the third spool 48 in opposite directions into positions that control the flow of fluid to and from the work ports 28 and 29.

Work port 28 is connected to another pressure relief valve 88 which relieves excessive work port pressure to the tank outlet 40 and 22. As seen in FIG. 2, this pressure relief valve 88 is located on the first secondary side 16 of the body 12 below the end cap 84 for the associated third bore 43.

Referring to FIG. 5, separate load check valves 91, 92 and 93 are located in the passage in the body 12 from pump inlet 20 to each of the valves 71, 72 and 73, respectively. These load check valves are located under plugs 94, 95 and 96 in holes in the first primary side 14 of the valve body 12 as shown in FIG. 1. Another check valve 98 associated with the boom base work port 28 is located in a cavity behind plug 87. which seals an opening on the fourth secondary side 19 as seen in FIG. 1. This check valve prevents unwanted back-flow associated with the main valves series circuit.

With reference again to FIG. 5, the pilot pressure inlet port 79 communicates with the supply passage 77 which leads through the valve body to another port 75 at the opposite side as shown in FIG. 2. Thus either port 75 or 79 may be used to couple a hose that-supplies pressurized fluid to the pilot solenoid valves 76 and 78. An optional accumulator can be connected at the other of these ports 75 or 79 to maintain a pressurized supply of hydraulic fluid for use by the solenoid valve 76 and 78. This option supplies the system hydraulic plumbing on the skid steer loader.

The design of the valve assembly 10 has great flexibility in that the same monolithic body 12 can be machined differently so that the control ports 30–35 can accept either a solenoid control valve or the fitting of a hydraulic hose from a remote pilot valve. This enables different types of control mechanism to operate the three valves within the valve assembly 10. For example, if the second control valve 72 is to be controlled by another pair of solenoid valves, the associated control ports 32 and 33 would be machined to accept the stem of that type of valve, instead of a hose fitting. In addition, a passage would be drilled from the control ports 32 and 33 to the passage 77 leading to the pilot pressure inlet port 79 (FIG. 5). The design of the valve body allows such additional passages to be formed to accommodate various combinations of electrohydraulic and conventional pilot valve operation of each of the control valves 71–73.

The valve assembly 10 provides simplified connectivity over that found in previous monolithic valve blocks and sectional spool valves. In particular all the work ports and control ports are located on the same primary surface 14 of the valve body for easy connection of the hoses and solenoid valves. The pilot pressure inlet port 79 communicates with a passage 77 through the valve body, which leads to another port 75 at the opposite side of the valve body 12 as shown in FIG. 2. Thus, either port 75 or 79 may be used to couple a hose that supplies the pilot pressure to the valve body, and the other pilot pressure port can be used to couple to an accumulator to maintain a supply of that pilot pressure for use by the solenoid valve 76 and 78 and other similar optional solenoid valves.

What is claimed is:

1. A hydraulic valve assembly comprising:

a body formed from a single piece of material and having two primary sides and at least two opposing secondary sides extending between the primary sides, a plurality of valve bores extend between the two opposing secondary sides, an inlet and an outlet communicating with the plurality of valve bores, and a plurality of pairs of work ports with each pair extending from one primary side to a different one of the plurality of valve bores, the body further including a plurality of first control ports each extending from the one primary side to an end of a different one of the plurality of valve bores, and a plurality of second control ports each extending from the one primary side to another end of a different one of the plurality of valve bores;

a separate control spool in each of the plurality of valve bores for controlling flow of hydraulic fluid between each work port and the inlet and outlet, and defining a separate chamber at each end of the plurality of valve bores which chambers communicate with one of the first control ports and second control ports; and a plurality of pilot pressure control elements each received in a different one of the first control ports and second control ports to define pressure in a respective chamber of an associated one of the plurality of valve bores.

2. The hydraulic valve assembly as recited in claim 1 wherein each pilot pressure control element is selected from a group consisting of a fluid conduit and an electrically operated valve.

3. The hydraulic valve assembly as recited in claim 1 wherein the body further comprises a pilot pressure inlet which communicates with the first control port and the second control port for at least one of the valve bores.

4. The hydraulic valve assembly as recited in claim 1 wherein the body further comprises a plurality of relief ports extending through one secondary side, and each relief port having a pressure inlet communicating with one of the work ports and a pressure outlet communicating with the outlet.

5. The hydraulic valve assembly as recited in claim 4 further comprising a plurality of pressure relief valves received in the plurality of relief ports.

6. The hydraulic valve assembly as recited in claim 1 wherein the body further comprises a plurality of apertures in the one primary side, and each aperture communicating with the inlet and one of the plurality of valve bores; and further comprising a plurality of check valves each located in one of the apertures to control fluid flow between the inlet and the respective one of the plurality of valve bores.

7. A hydraulic valve assembly comprising:

a monolithic body having first and second primary sides and first, second, third, and fourth secondary sides extending between the first and second primary sides, a plurality of valve bores extending between the first and third secondary sides, an inlet and an outlet both communicating with the plurality of valve bores, a plurality of pairs of work ports extending through the first primary side and each pair communicating with a different one of the plurality of valve bores, a plurality of first;control ports extending through the first primary side and each one communicating with one end of a different one of the plurality of valve bores, and a plurality of second control ports extending through the first primary side and each one communicating with another end of a different one of the plurality of valve bores;

a plurality of control spools each slidably received in a different one of the plurality of valve bores for controlling flow of hydraulic fluid between each work port and the inlet and outlet, and defining a separate chamber at each end of the plurality of valve bores which chambers communicate with one of the first control ports and second control ports; and a plurality of pilot pressure control elements each received in a different one of the first control ports and second control ports to control pressure in a respective chamber of an associated one of the plurality of valve bores, each pilot pressure control element selected from a group consisting of a fluid conduit and an electrically operated valve.

8. The hydraulic valve assembly as recited in claim 7 further comprising a plurality of springs each received in a different one of the chambers of the plurality of valve bores and biasing one of the plurality of the control spools away from an end of the associated valve bore.

9. The hydraulic valve assembly as recited in claim 7 wherein the body further comprises a pilot pressure inlet which communicates with those of the first control ports and second control ports in which an electrically operated valve is received.

10. The hydraulic valve assembly as recited in claim 7 wherein the body further comprises a plurality of relief ports opening through the first secondary side, and each relief port having a pressure inlet communicating with one of the work ports and a pressure outlet communicating with the outlet; and a plurality of pressure relief valves each received in one of the relief ports and controlling pressure of hydraulic fluid between the associated work port and the pressure outlet.

11. The hydraulic valve assembly as recited in claim 7 wherein the body further comprises a relief port extending through one of the secondary sides and communicating with the inlet and the outlet; and a pressure relief valve received in the relief port.

12. The hydraulic valve assembly as recited in claim 7 wherein the body further comprises a plurality of apertures in the first primary side, and each aperture communicating with the inlet and one of the plurality of valve bores; and further comprising a plurality of check valves each located in one of the apertures to control fluid flow between the inlet and the respective one of the plurality of valve bores.

13. The hydraulic valve assembly as recited in claim 7 herein the second secondary side of the body has a pair of threaded apertures for securing the hydraulic valve assembly to a piece of equipment.

14. A hydraulic valve assembly comprising:

a body formed from a single piece of material, and having two primary sides and at least two opposing secondary sides extending between the primary sides, an inlet, an outlet, and a plurality of valve structures defined in the body wherein each valve structure comprises:

(a) a bore that extends between a first opening in one opposing secondary side and a second opening in another opposing secondary side, and communicating with the inlet and the outlet, (b) a pair of work ports extending from one primary side to the bore, (c) a first control port extending from the one primary side to a portion of the bore that is adjacent the first opening, and (d) a second control port extending from the one primary side to another a portion of the bore that is adjacent the second opening;

a separate control spool in each bore of the plurality of valve structures for controlling flow of hydraulic fluid between each work port and the inlet and outlet;

a separate pair of pilot pressure control elements for each of the plurality of valve structures, one pilot pressure control element of the pair received in one of the first control port and the first opening of the respective valve structure, and another pilot pressure control element of the pair received in one of the second control port and the second opening of the respective valve structure.

15. The hydraulic valve assembly as recited in claim 14 wherein each pilot pressure control element is selected from a group consisting of a fluid conduit and an electrically operated valve.

16. The hydraulic valve assembly as recited in claim 14 wherein the body further comprises a pilot pressure inlet which communicates with the first control port and the second control port for at least one valve structure.

17. The hydraulic valve assembly as recited in claim 15 wherein the body further comprises a plurality of relief ports extending through one opposing secondary side, and each having a pressure inlet communicating with one of the work ports and a pressure outlet communicating with the outlet.

18. The hydraulic valve assembly as recited in claim 17 further comprising a plurality of pressure relief valves received in the plurality of relief ports.

* * * * *

UNITED STATES PATENT AND TRADEMARK OFFICE

CERTIFICATE OF CORRECTION

PATENT NO. : 6,505,645 B1
DATED : January 14, 2003
INVENTOR(S) : Andreas S. Pack et al.

It is certified that error appears in the above-identified patent and that said Letters Patent is hereby corrected as shown below:

Column 6,
Line 54, delete the semi-colon.

Column 8,
Line 35, replace “15” with -- 14 --.

Signed and Sealed this

Sixth Day of May, 2003

JAMES E. ROGAN
*Director of the United States Patent and Trademark Office*